United States Patent [19]

Hull

[11] Patent Number: 4,583,382

[45] Date of Patent: Apr. 22, 1986

[54] REVERSIBLE LATCH ASSEMBLY WITH INTEGRATED FUNCTION

[75] Inventor: Scott A. Hull, Burlingame, Calif.

[73] Assignee: Schlage Lock Company, San Francisco, Calif.

[21] Appl. No.: 564,037

[22] Filed: Dec. 21, 1983

[51] Int. Cl.[4] ..... E05B 59/00

[52] U.S. Cl. ..... 70/107

[58] Field of Search ..... 70/107, 110, 111, 470, 70/472, 150, 149; 292/34, 36, 40, 165

[56] References Cited

U.S. PATENT DOCUMENTS

| | | | |
|---|---|---|---|
| 2,029,991 | 2/1936 | Eichel | 70/107 |
| 3,672,714 | 6/1972 | Schultz | 70/107 |
| 3,769,822 | 11/1973 | Yulkowski | 70/107 |
| 3,808,849 | 5/1974 | Alexander | 70/107 |

*Primary Examiner*—Robert L. Wolfe

*Attorney, Agent, or Firm*—Walter C. Vliet; Bernard J. Murphy

[57] ABSTRACT

A mortise lock having reversible features to permit accommodating both left and right hand door applications. The lock includes the novel features of a resilient fire stop, simultaneous retraction of both the dead bolt and latch bolt mechanism by operation of the interior handle, and a three-position thumb turn function which variously unlocks the lock, locks against operation of the latch bolt by the exterior handle and finally, locks the latch bolt against operation by the outside handle and deploys a secure dead bolt. Other features of the lock include clockwise and counter clockwise rotation of either handle, separate rotation of the inside and outside handle and an auxiliary latch which prevents externally induced retraction of the latch bolt when the door is closed. Features also include an auxiliary lever handle assist spring. A new slide plate and cam operated lock works are provided to accomplish the locking function of the present invention.

16 Claims, 22 Drawing Figures

50
92
94
55
51
86
90
52
92
53
90
94
52
92
50
86
55
51
22
22
81
81
2
88
80
17
82
84
9

REVERSIBLE LATCH ASSEMBLY WITH INTEGRATED FUNCTION

BACKGROUND OF THE INVENTION

The present invention relates to a latch assembly sometimes referred to as a mortise lock. The lock is of the character which is intended to be received in a socket or recess in the edge of a door and of such construction that it may be arranged for selected association with either a right hand opening door or with a left hand opening door.

The invention further relates to functions interrelated in the lock mechanism and the adaptability of the lock assembly to right hand and left hand opening door use without disassembly of the lock case.

OBJECTS OF THE INVENTION

The primary object of the invention is to provide a lock assembly wherein the function of a dead bolt, a latch bolt, and an auxiliary latch are interrelated and selectively controlled from both within and without the door by independent operation of the door handles. The door is also operated exteriorly by a key cylinder and interiorly by a thumb turn.

A further object of the invention is to provide a means for resiliently resisting operation of the latch bolt in the event of fire.

A further object of the invention is to provide for reversible application of the lock without the need for lock disassembly.

A further object of the invention is to provide a means for simultaneously retracting the dead bolt and latch bolt by operation of the interior handle.

A further object of the invention is to provide a novel auxiliary spring for use with L-shaped handles to thereby offset the added leverage and/or weight of the handle in lock operation.

Yet a further object of the invention is to provide a simple, safe, reliable, and economic to manufacture lock.

To accomplish the above and related objects, my invention may be embodied in the form illustrated in the accompanying drawings, attention being called to the fact, however, that the drawings are illustrative only and that changes may be made in the specific instruction illustrated and described to accomplish my invention. The scope of which is defined in the appended claims.

These and other objects are obtained in a lock assembly comprising:

1. A door lock comprising:

a generally rectangular case having one edge adjacent a door frame and having at least an inside side and outside side for enclosing the lock works;

a latch bolt disposed in the case a portion of which is selected extensible from the one edge of the case for securing relative movement between the door and the door frame;

a dead bolt disposed in the case, a portion of which is selectively extensible from the one edge of the case; for further securing relative movement between the door and the door frame; disposed on the outside of side of the case;

a first lockable handle means for selectively retracting the latch bolt;

a second handle means disposed on the inside side of the case for simultaneously retracting the latch bolt and the dead bolt;

a first lock means within the case for securing the handle mean from operation;

a second lock means operable from the inside side of the door for selectively releasing the first lock mean and retracting the dead bolt in a first position, deploying the first lock means in a second position and deploying the first lock and extending the dead bolt in a third position;

a third key operated lock means operable from the outside side of the door for selectively retracting the latch bolt and;

means for preventing operation of the third lock means when the dead bolt is extended.

BRIEF DESCRIPTION OF THE DRAWINGS

FIG. 11 shows the thumb turn hub in the unlocked position.

DESCRIPTION OF THE PREFERRED EMBODIMENT

Figure 1:
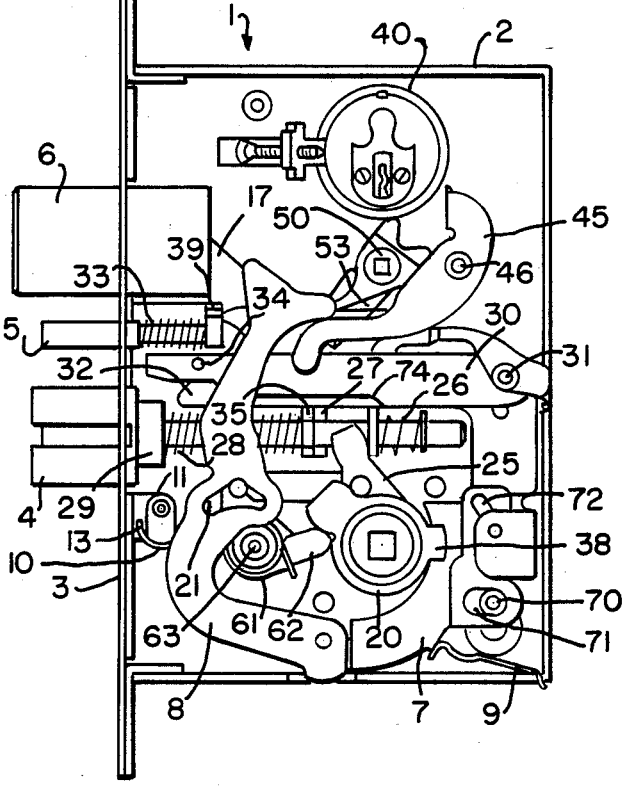
FIG. 1 is an elevation assembly view showing the general assembly and components comprising my invention.

Referring now to FIG. 1, a mortise lock assembly according the present invention is shown generally by reference numeral 1.

The mortise lock comprises a case 2 of generally rectangular box configuration. In normal installation the mortise lock is installed in a mortise recess in one edge of a door. The lock is retained in the door edge by means of screws or similar retaining devices disposed in one edge of the case. Corresponding to the edge of the door are a latch bolt 4, auxiliary latch 5, and a dead bolt 6. Each of these devices are selectively capable of extending out from the case of the mortise lock beyond the edge of the door. The dead bolt and the latch bolt cooperate with appropriate recesses in the door frame to prevent relative movement of the door edge and the door frame, thereby accomplishing the locking of the door.

The auxiliary latch 5 performs the function of preventing the latch bolt from being externally depressed by intrusion devices (for example, a credit card) when the auxiliary latch is depressed against the door frame. The lock is provided with a armor plate 3 which serves to align the latch bolt 4, the auxiliary latch 5, and dead bolt 6 as well as prevent intrusion into the lock case 2 from the door edge.

A key cylinder 40 is installed in the mortise lock in conventional manner and provides means for operating the latch bolt by means of a key from exterior side of the door. A key cylinder transfer lever link 45 cooperates with the key cylinder 40 to accomplish retraction of the latch bolt. Rotation of the key cylinder with the proper key inserted, activates key cylinder link 45 to rotate about link pivot 46. The link engages latch bolt saddle 27 and thereby retracts the latch bolt. A unique feature of the key cylinder link is found in that bent tab 47 on dead bolt plate 17 will rotate link 45 out of engagement with the key cylinder 40 when the dead bolt is thrown. This prevents key operated retraction of the latch bolt until the dead bolt is retracted.

Also shown in FIG. 1 are the retractor hubs 20 which are operated by the lock handles and permits under certain conditions the retraction of the latch bolt 4. The description of the operation of the retractor hub will be more particularly described in relation to FIGS. 9 and 10.

The lock is provided with a stop works catch 7 which selectively secures the retractor hub from rotation. A stop works index spring 9 permits accurate positioning and retention of the stop works. A latch bolt operator 25 operates in response to rotation of the retractor hub 20. The latch bolt operator 25 contacts saddle 27 of the latch bolt 4 and provides the direct contact means for retracting the latch bolt.

Dead latch stop 30 is pivoted at its one end on dead latch stop pivot 31 and rests at its other end on auxiliary latch cam 32. When auxiliary latch 5 is depressed, auxiliary latch cam 32 is displaced to the right as shown in FIG. 1. This allows dead latch stop 30 to rotate counter-clockwise a small amount sufficient for the end of the latch bar to interfere with retraction of the latch bolt 4.

It should be appreciated that dead latch stop 30 must be lifted by the saddle 27 before the latch bolt may be retracted. Saddle 27 is slideably mounted on the latch bar and resiliently positioned by release spring 26. Latch bar extension spring 28 serves to extend latch bolt 4 by interaction between the latch bolt hub 29 and saddle stop/latch bolt guide 35.

Thumb turn hub 50 comprises a rotary actuator with the capability of accumulating some small degree of lost motion. Thumb turn hub 50 selects one of three modes of operation of the lock by movement and release of a series of slide bars and cams which will be later described. A portion of these components and devices may be seen in FIG. 1 and will be better understood by later references to FIGS. 11, 12, 13.

Simultaneous retractor 8 functions as a control link between the operation of the thumb turn 50 and the retractor hub 20. Its function will be later described in detail.

Figure 2:
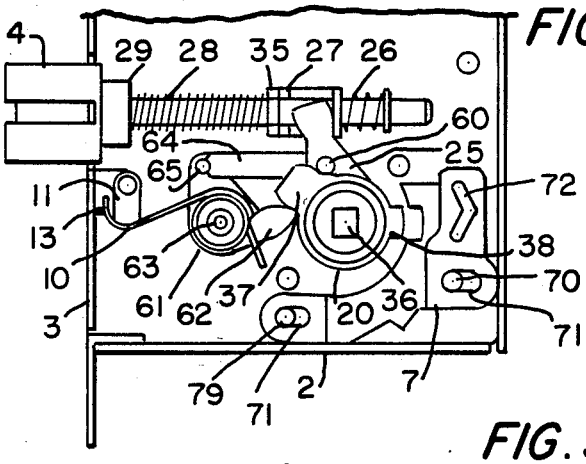
FIG. 2 shows the lower half of the lock in elevation view with some overlaying components removed and the stop works in the unlocked position.

Referring now to FIG. 2, retractor hub 20 is rotably mounted in the lock case 2 and is operated by means of the lock handles through square drive 36. Retractor hub 20 is comprised of two identical overlayed sections each having a gear tooth like operating tooth 37 and a stop works engaging projection 38. The mounting of the two identical sections permits either section to rotate clockwide or counter clockwise independent of each other. One section lies to the inside side of the lock case. The other lies to the outside side of the lock case. In FIG. 2 only the retractor hub section towards the viewer may be seen. It should be appreciated that rotation of one of the retractor hubs will not rotate at the other hub. However, since both hubs provide the same function, it should be understood that rotation of the inside hub may operate the latch bolt while the outside hub is locked from outside rotation by the stop works.

Figure 9:
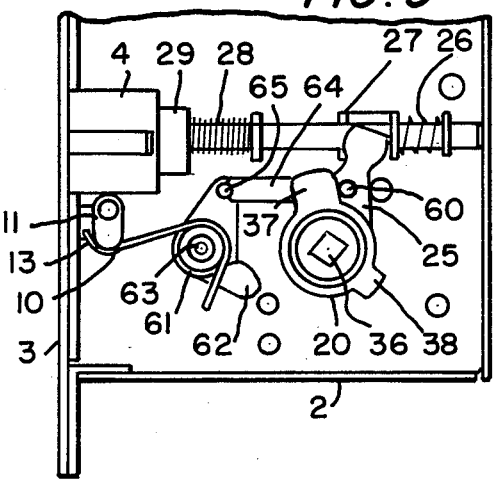
FIG. 9 is a side elevation view of the lower half of the lock assembly showing the operation of the handle operated retractor rotated in the clockwise direction for retracting the latch bolt.
Figure 10:
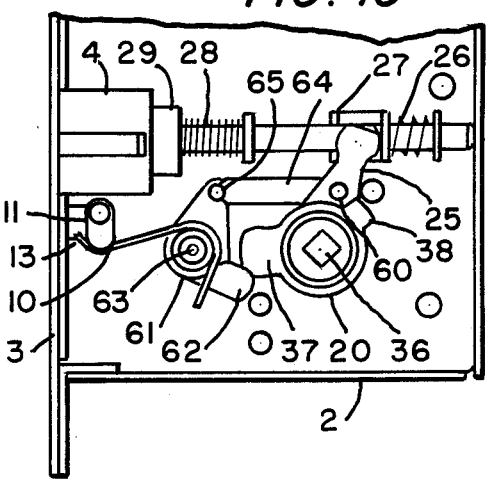
FIG. 10 is a side elevation view of the lower half of the lock assembly showing the operation of the handle operated retractor rotated in the counterclockwise direction for retracting a latch bolt.

Referring now to FIGS. 9 and 10, clockwise rotation of the retractor hub will cause operating tooth 37 to engage pin 60 on the latch bolt operator 25. This will in turn cause the latch bolt operator 25 to rotate about the center of the retractor hub 20 and thereby through contact with the latch bolt saddle 27 cause the latch bolt to be displaced to the right as shown in FIG. 9.

Counter-clockwise rotation of the retractor hub causes the operating tooth 37 to contact bell crank 61 at its full depth tooth-like projection 62. The contact rotates bell crank 61 about pivot 63 in a clockwise direction thereby displacing reverse retractor link 64 to the right as shown in FIG. 10. Reverse retractor link 64 is pivotally connected to the bell crank 61 at pivot point 65 on its one end and pin 60 on its other end.

Retractor spring 10 resists the clockwise rotation of the bell crank 61 and restores the retractor hubs to the neutral position when the lock handles are released.

In FIG. 2 the stop works are located towards the viewer. In FIG. 2, the stop works are disengaged from the retractor hub allowing it to rotate.

Figure 3:
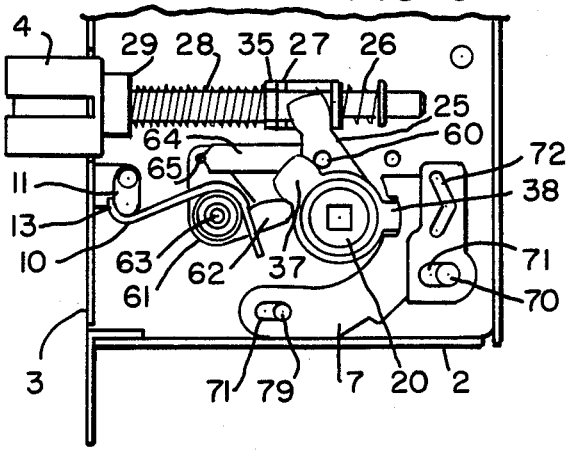
FIG. 3 repeats FIG. 2 with the stop works in the locked position.

FIG. 3 shows the same portion of the lock as FIG. 2 with the stop works 9 displaced to the left thereby engaging projection 38 on the retractor hub 20. This position locks the outside handle (towards the viewer) and prevents retraction of the latch bolt from the outside side of the lock.

The stop works catch 7 is slideably mounted on pins 70 and 79 which cooperated with the elongated holes 71 in the stop works catch 7 to permit horizontal displacement of the stop works from the locked to the unlocked position. Stop works cam slot 72 provides the drive to displace the stop works from the locked to the unlocked position. The cam function will be later described in conjunction with FIGS. 11 through 13 which are referred to, describe the operation of the thumb works.

Figure 4:
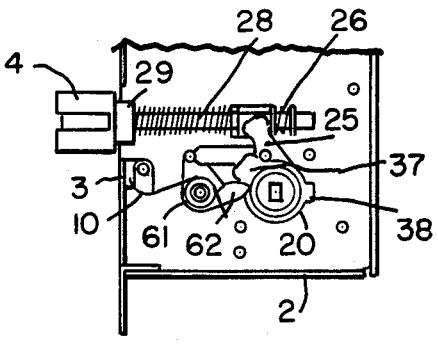
FIG. 4 is again a side elevation view of the lower half of the lock showing the latch bolt extended beyond the case in order to permit hand reversal of its function.
Figure 5:
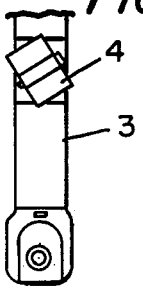
FIG. 5 is an end elevation view showing the latch bolt partially rotated.
Figure 6:
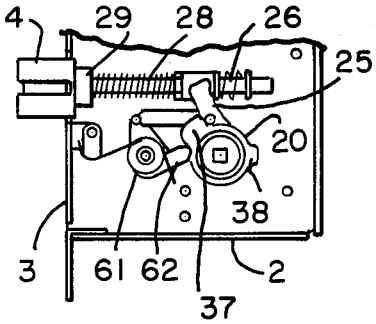
FIG. 6 repeats FIG. 4 with the latch bolt rotated and retracted in the case in its normal position.

Referring now to FIG. 4 through FIG. 6. The mortise lock of the present invention is provided with a latch bolt 4 which is reversible to accomodate the opposite door hands. In order to accomplish reversal, it is necessary to remove armor plate 3 which will then permit latch bolt 4 to be displaced to the left against the action of release spring 26 as shown in FIG. 4. Once the latch bolt has been withdrawn from the case 2, to the point where latch bolt hub 29 barely remains in the case. The latch bolt may be rotated as shown in FIG. 5 to the opposite hand position shown in FIG. 6 whereupon the latch bolt 4 is released and permitted to retract into the case 2. Replacement of the armor plate 3 completes the latch bolt reversal procedure.

Figure 7:
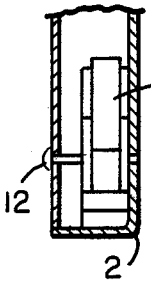
FIG. 7 is a partial end elevation view showing the stop works in a first position for one hand of operation.
Figure 8:
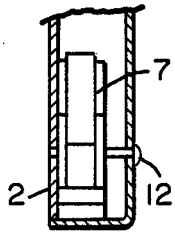
FIG. 8 shows the stop works displaced to the left relative to FIG. 7 for the opposite hand of operation.

Referring now to FIGS. 7 and 8, the position of the stop works catch 7 relative to the front or back of the case determines which handle operates as the interior handle and which handle operates as the exterior or locked handle. Stop works catch 7 is mounted on guide pins 70 and 79 which cooperate with elongated holes 71 in the stop works as previously described. The guide pins also allow the stop works to be displaced from the right hand side of the case as shown in FIG. 7 to the left hand side as shown in FIG. 8. As shown in FIG. 7, the right hand side becomes the exterior side. In FIG. 8, the left hand side is the exterior side. It should be understood that the stop works only engages one of the two retractor hubs as previously described. Positioning of the stop works is accomplished by means of inserting a spacer screw 12 in the appropriate side of the case thereby displacing the stop works catch to the opposite side of the case.

Figure 14:
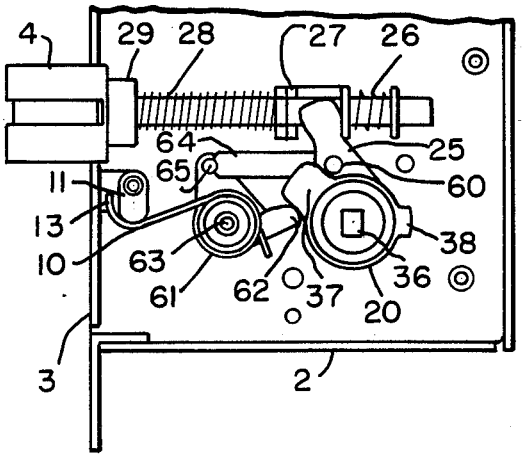
FIG. 14 is a side elevation view of the lower half of the latch assembly according to the present invention showing the combination retractor spring and fire stop in its normal position.
Figure 15:
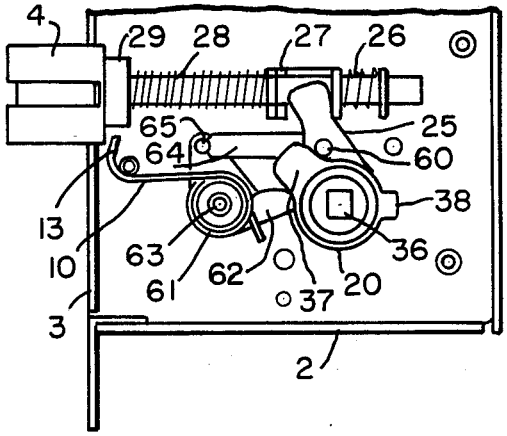
FIG. 15 repeats FIG. 14 showing the combination retractor spring in its resilient fire stop position.

The retractor spring 10 serves a second function as shown in FIGS. 14 and 15. One end of retractor spring 10 is in contact with bell crank 61 and rotates therewith. The other stop end 13 of the spring contacts a fusible link 11 which prevents upper movement of the spring as shown in FIG. 14. As a safety feature in case of fire, fusible link 11 will melt thereby permitting the stop end 13 of the retractor spring 10 to move further upward as shown in FIG. 15 to a position which resiliently interferes with retraction of the latch bolt 4. It is intended that the stop end 13 provided sufficient resistance to prevent accidental rotation of the retracting mechanism in the event of fire hose spray contacting the lock handles. Sufficient force, however, may be applied to the handles in case of emergency to permit opening of the door. It is believed that the resilient restraint is a unique feature of the present mortise lock.

A further unique feature of the present lock is shown and will be described in reference to FIGS. 11 through 13. The unique feature involves the combined three-position function of the thumb turn hub 50.

Figure 11:
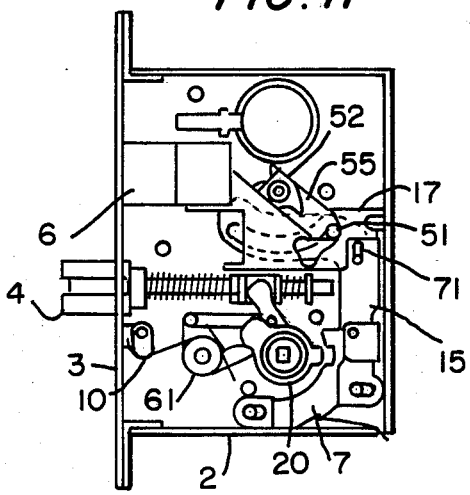
FIG. 11, 12, 13 are side elevation views of the lock assembly according to this invention showing the simultaneous function of the thumb turn.

In FIG. 11, the thumb turn hub is shown in its unlocked position fully rotated in the counter-clockwise direction. In this position, both the interior and exterior handles of the door will operate and open the lock. Both the dead bolt 6 and the stop works catch are in the unlocked position.

Figure 12:
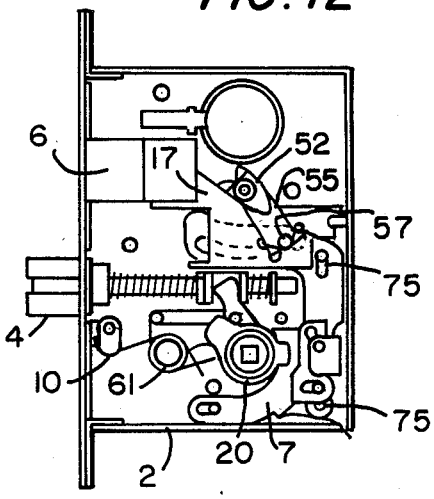
FIG. 12 shows the thumb turn hub in the locked position.

Rotation of the thumb turn hub 50 approximately 20 degrees in the clockwise direction as shown in FIG. 12 sets the stop works catch to the locked position.

Figure 13:
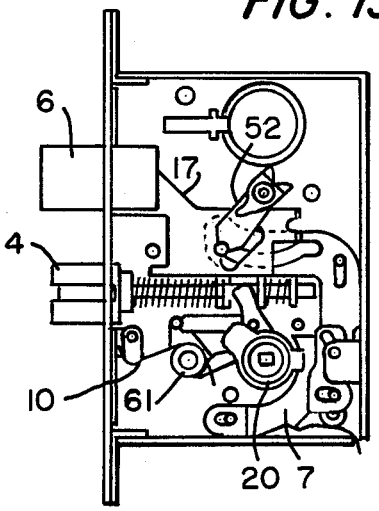
FIG. 13 shows the thumb turn hub in the locked position with dead bolt thrown.
Figure 16:
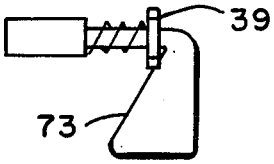
FIG. 16 is an elevation view of the auxiliary latch operating mechanism of the present invention.

Rotation of the thumb turn hub 50 approximately 90 degrees clockwise from the unlocked position, as shown in FIG. 13, in addition to setting the stop works catch, throws the dead bolt to its locked position. Rotating the thumb turn counter clockwise from the third position first retracts the dead bolt and finally releases the stop works catch.

Figure 18:
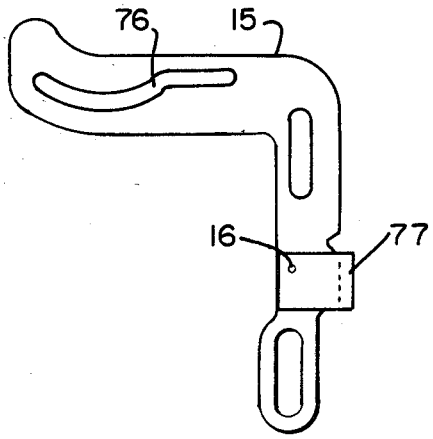
FIG. 18 is a detail of the stop works plate according to the present invention.

The combined thumb turn function is accomplished by action on two operating slide plates. Stop works link plate 15 is mounted for linear translation in the vertical direction as shown in FIGS. 11 through 13. Guide pin 31 near the top of the stop works plate and guide pin 70 located near the bottom of stop works plate 15 cooperate with elongated slots 75 in the stop works plate to permit the translation movement. Stop works plate 15 is provided with a arcuate cam slot 76 which cooperates with a camming pin 51 on thumb turn hub 50. The shape of arcuate cam slot 76 is best seen on FIG. 18 as are the elongated slots 75.

The stop works plate 15 is provided with a folded-over bracket 77 which supports stop works cam pin 16. The stop works cam pin 16 cooperates with a V-shaped stop works cam 72 in such a manner that displacement of the stop works plate vertically upward cams the stop works catch to the right or unlocked position as shown in FIG. 11.

Arcuate cam slot 76 is designed so that the first 20 degrees of rotation of the thumb turn 50 creates downward movement of the stop works plate to the locking position as can be seen in FIG. 12. Continuing rotation through the remainder of the arcuate cam slot produces no futher movement of the lock works plate.

Figure 17:
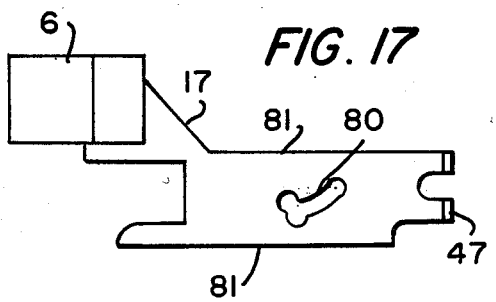
FIG. 17 is an elevation view of the dead bolt and dead bolt plate according to the present invention.

The second operating plate may be referred to as the dead bolt plate 17, best seen in assembly of FIG. 13. Details of the dead bolt plate are shown in FIG. 17. Dead bolt 6 is shown attached to the dead bolt plate 17. Dead bolt plate 17 is guided on guide surfaces 81 for horizontal translation from a withdrawn or unlocked position to the right (as shown in FIGS. 11 and 12) and to the left or locked position (as shown in FIG. 13). An arcuate cam slot or dead bolt cam slot 80 is shown on FIG. 17. Dead bolt cam slot 80 cooperates with cam pin 51 to effect the throw of the bolt as the thumb turn hub is rotated. The design of dead bolt cam slot 80 also locks the dead bolt in the extended position.

Figures 21, 22:
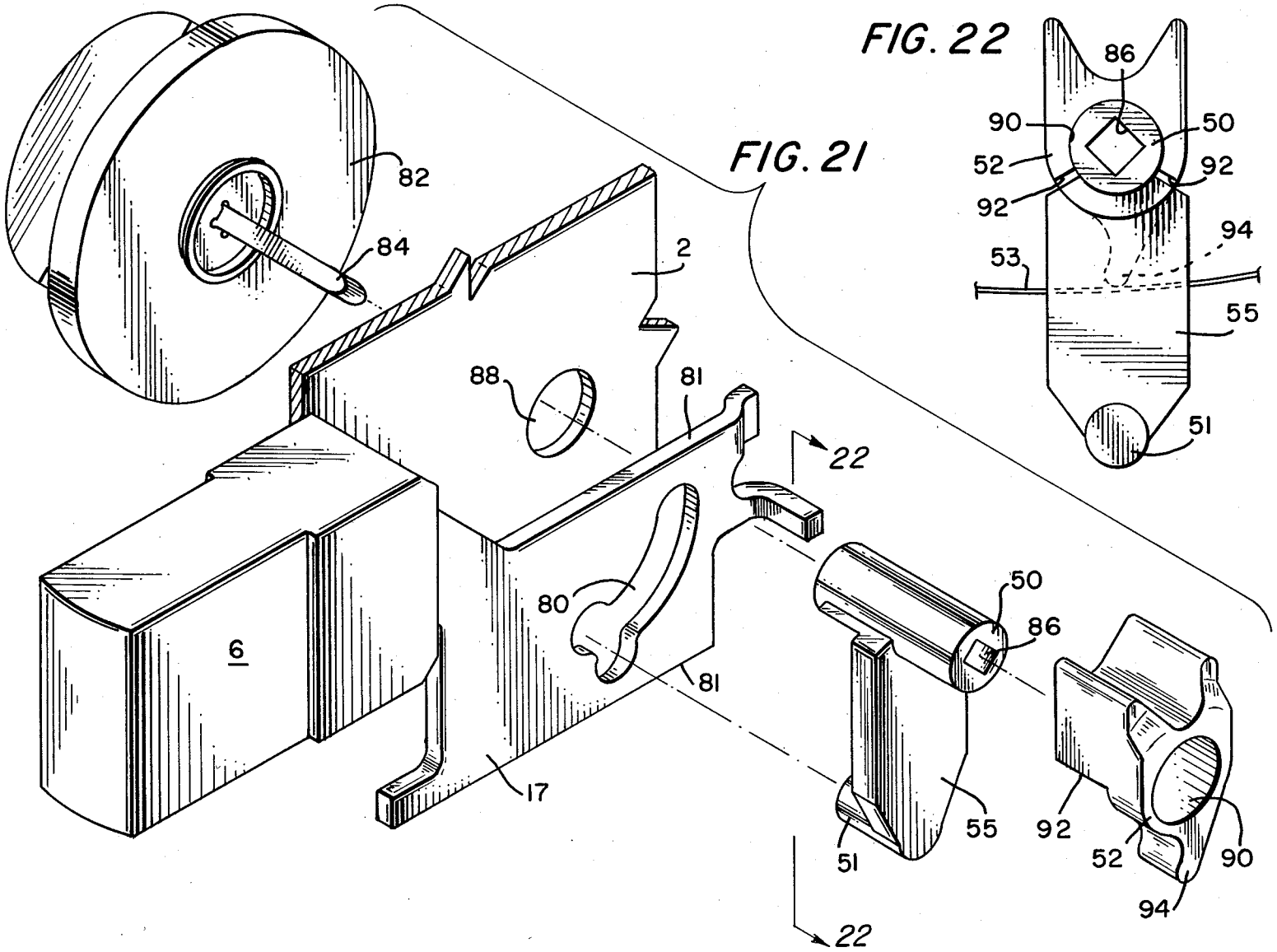
FIG. 21 is an exploded view of a portion of the case, the thumb turn, the lever, lost motion cam, and dead bolt.
FIG. 22 is a view of the assembled and interactive lost motion cam and thumb turn lever, and it further shows a portion of the cam biasing spring

The FIG. 21 exploded view, and the FIG. 22 illustration, show the cooperation of the thumb turn 82, dead bolt plate 17, dead bolt cam slot 80, thumb turn lever 55, cam pin 51, lost motion cam 52, and spring 53. Pin 51 is slidably engaged with the slot 80 in plate 17 and, as a consequence, rotation of the thumb turn hub 50 causes the thumb turn lever 55 to slue and effect a translation of plate 17 and dead bolt 6. The thumb turn 82 has a square shank 84 which engages a square bore 86 in the thumb turn hub 50, and the hub is rotatably journaled in apertures 88 (only one is shown) in the case 2. The lost motion cam 52 has a circular bore 90 formed therein and the latter slidably receives one end of the hub 50. A pair of laterally-disposed shoulders 92 of the lost motion cam 52 are set astride the thumb turn lever 55. Too, the cam 52 has a depending lobe 94 which is engaged with, and biased by, a leaf spring 53. The leaf spring 53 and the lost motion cam 52 serve as a sort of detenting means for the thumb turn 82. The spring 53 resiliently restrains the lobe 94 in the two angular dispositions of the cam 52 shown in FIGS. 11 and 13. Accordingly, to rotate the thumb turn 82 from one of these positions to the other thereof, the bias of the spring 53 must be overcome to allow the lobe 94 to slue through an arc. Too, on rotating the thumb turn 82 in either direction, one of the shoulders 92 impacts against the lever 55. Consequently, the throw of the dead bolt 6 is accompanied with an audible sound ("snap") and a tactual sensation transmitted through the thumb turn 82 to the manipulating fingers. The bias of the spring 53 inhibits an inadvertent or unintended throw of the dead bolt, and the aforesaid audible sound and tactual sensation annunicate the dead bolt translation.

Lost motion cam 52 contacts simultaneous retractor 8 best seen in FIG. 1. Simultaneous retractor 8 is pivotally mounted about pin 79 which also forms a guide pin for stop works catch 7. A retractor cam slot 21 cooperates with a pin projection of pivot point 65 of the bell crank 61. As seen in FIG. 1, movement of pivot point 65 to the right will displace the top portion of the simultaneous retractor 8 to the right which through lost motion cam 52 will tend to rotate the thumb turn counter clockwise and thereby effecting retraction of the dead bolt 6. It will, therefore, be appreciated by one skilled in the art that rotation of the inner or unlocked handle will simultaneously retract the dead bolt and the latch bolt permitting egress from the area without use of the thumb turn at any time.

Auxiliary latch 5 has, integral therewith, the auxiliary latch cam 32. Latch 5 comprises a projecting nosepiece, for engaging a door frame, and a shank which extends into the case 2. The shank is slidably engaged in a guide 39 which constrains the latch 5 to a horizontal displacement. Depending from the innermost end of the shank is a generally triangular-shaped plate which defines the aforesaid cam 32. The latter has an inclined edge which is the camming surface thereof. The dead latch stop 30, a long limb which extends almost fully across the case 2. is pivoted at the end thereof which is furthest from the auxiliary latch 5. The other end of the dead latch stop 30 has a pin 34 fixed therein and extending, perpendicularly, therefrom. The pin 34 is slidably engaged with the aforesaid inclined-edge, camming surface of the cam 32. Thus, when the latch 5 is retracted into the case 2, it displaces the integral cam 32 rearwardly (i.e., inwardly in the case 2). This allows the foremost, slueing end of the dead latch stop 30 to drop, because the pin 34 is free to travel down along the camming surface. of the cam 32 and, with the slueing end of the stop 30, comes free of the cam. When the foremost end of the dead latch stop 30 drops, it is obstructive of the latch bolt 4. In this disposition, the dropped end of the latch stop 30 is poised just behind the latch bolt 4 (in the preferred embodiment, within approximately one-quarter of an inch behind the latch bolt 4). Thus, the latch bolt 4 cannot be retracted unless, and until, the dead latch stop 30 is lifted.

Displacement of the saddle 27 rearwardly (i.e., to the right, in the figures) will lift the latch stop 30 from obstruction of the latch bolt 4. Accordingly, with rotation of retractor hub 20, the latch bolt operator 25 slues to the right and, and a consequence, displaces the saddle rearwardly. The rearmost portion of the saddle 27 comes into impinging engagement with the cam step 74 formed in the lower edge of the latch stop 30, and simply lifts the latter out of the way—so that the saddle 27 can pass therebeyond, sliding along that lower edge of the latch stop 30, and to permit the latch 4 to retract into the case 2.

Figure 19:
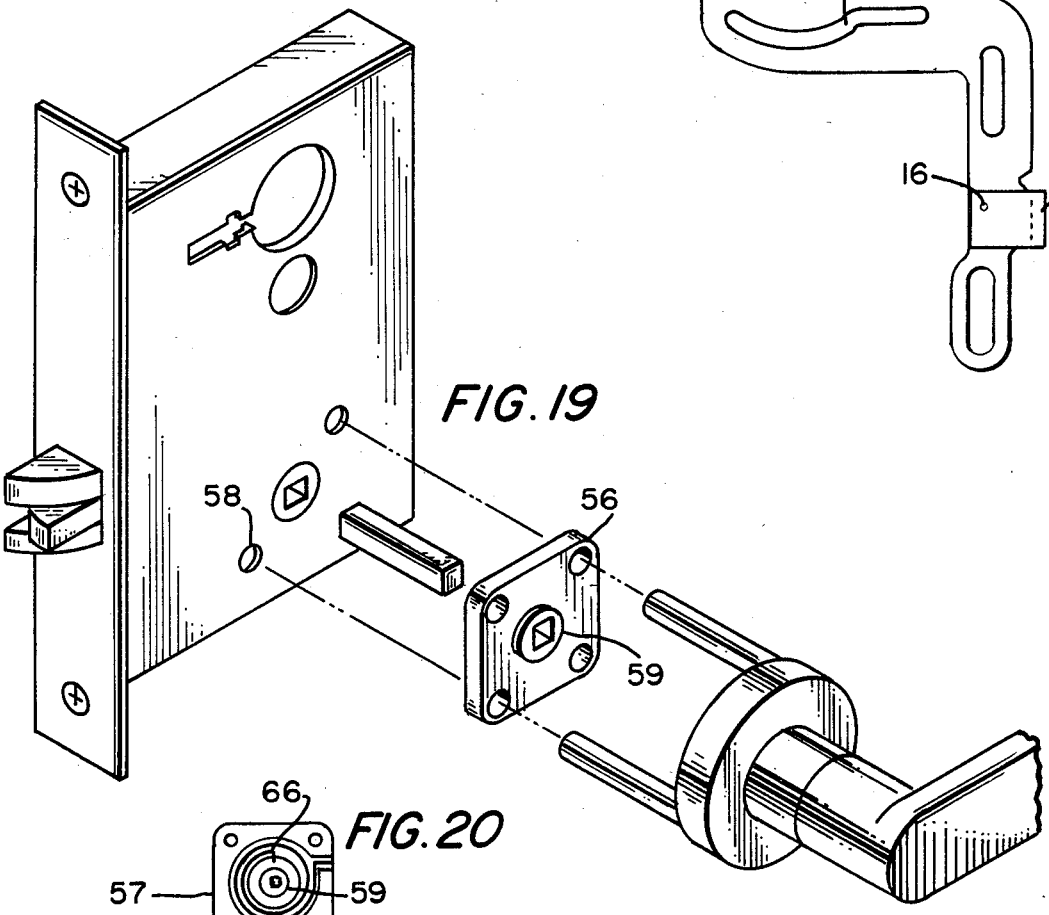
FIG. 19 shows the outside assembly view of a mortise lock according to the present invention further showing the assembly of a unique external spring package for assist in lever type operation.
Figure 20:
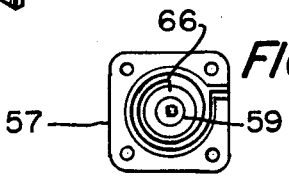
FIG. 20 is a detail of the lever handle spring package according to the present invention.

Use of lever "L" shape lock handles create additional rotating forces in the operation of the lock. One such force results from the off-set weight of the handle tending to rotate the lever to a vertical downward position. In order to accomodate this additional force in a reversible lock having optional lever handles, a unique added-on spring package 56 has been provided. The spring package 56 is best seen in the exploded assembly shown in FIG. 19. Details of construction of the spring package are shown in the section elevation view of the spring package (with cover removed) shown in FIG. 20. This spring package is comprised of a square case 57 which is provided with mounting holes which correspond with the mounting holes provided for the attached lock handles. A rotary mounted square drive hub 59 is centralized in case 57. Helical spring 66 is attached between the hub 59 and the case to provide rotary resistance to the hub 59 and thereby the handle of the lock. Spring 66 is preloaded to increase initial rotary resistance.

Having described my invention, in terms of a preferred embodiment, numerous modifications will now occur to persons skilled in the art. I do not wish to be limited in the scope of my invention except as claimed.

I claim:

1. A door lock comprising:

a generally rectangular case having a front plate for confronting a door frame and having at least an inside side and outside side for enclosing the lock works;

a latch bolt disposed in said case a portion of which is selectively extensible from said front plate of said case for securing relative movement between said door and said door frame;

a dead bolt disposed in said case, a portion of which is selectively extensible from said front plate of said case for further securing relative movement between said door and said door frame;

a first lockable handle means for selectively retracting said latch bolt disposed on the outside of the side of said case;

a second handle means disposed on the inside of said case for simultaneously retracting said latch bolt and said dead bolt;

a first lock means within said case for securing at least one of said first and second handle means against operation;

a second lock means operable from the said inside of said door for selectively releasing said first lock means and retracting said dead bolt in a first position, deploying said first lock means in a second position and deploying said first lock and extending said dead bolt in a third position;

a third key operated lock means operable from the outside side of said door for selectively retracting said latch bolt and said dead bolt;

means for preventing operating of said third lock means when said dead bolt is extended; and an inner and an outer retractor hub means which are axially aligned and mounted for independent rotation within said case, said inner retractor hub means being located adjacent to said inner side of said case and operated by said second handle means, said outer retractor hub means, being located adjacent to said outside side of said case and operated by said first lockable handle means.

2. A door lock according to claim 1 wherein said first lock means further comprises a means for preventing rotation of said first lockable handle means.

3. A door lock according to claim 2 wherein said means for preventing rotation of said first lockable handle comprises a stop works catch slideably mounted in said case for movement in and out of engagement with said outer retractor hub means.

4. A door lock according to claim 3 wherein said stop works catch is provided with a recess which cooperates with a projection on said outer retractor hub means to prevent rotation of said outer retractor hub means.

5. A door lock according to claim 4 wherein said stop works catch is selectively displaceable front to rear in said case to selectively engage either said innner or said outer retractor hub means thereby reversing the handle locking function.

6. A door lock according to clain 5 wherein displacement of said stop works catch is accomplished without lock disassembly by means of a spacer screw.

7. A door lock according to claim 2 wherein said means for preventing rotation of said first lockable handle means further comprises a stop works plate operated by said second lock means.

8. A door lock according to claim 7 wherein said stop works plate is provided with a compound arcuate cam having a first portion which displaces said stop works plate on movement of said second lock means from its first position to its second position, said displacement deploying said stop works catch by means of a cam on said stop works catch which cooperates with a cam pin on said stop works plate.

9. A door lock according to claim 1 wherein said latch bolt comprises means accommodating rotation thereof within said case thereby to effect reversal of the latch bolt function and to permit use of the lock on either left-hand or right-hand doors.

10. A door lock according to claim 1 further comprising a latch bolt retracting means including a latch bolt operator, bell crank and reverse link which cooperate with said inner and outer retractor hub means through a tooth-like projection on said hub means to translate rotary motion of either unlocked handle to said latch bolt and thereby retract said latch bolt allowing the door to open.

11. A door lock according to claim 10 wherein said latch bolt retracting means includes a retractor spring.

12. A door lock according to claim 11 wherein said retractor spring includes a stop end which is secured against displacement by means of a fusible link.

13. A door lock according to claim 12 wherein in a fire situation, said fusible link will melt thereby releasing said stop end of said retractor spring to a position which interferes with accidental retraction of said latch bolt.

14. A door lock according to claim 1 further comprising an external spring package to resist gravitational rotation of a lever handle.

15. A door lock according to claim 1 wherein said dead bolt is provided with a bent tab means which prevents said third key operated lock means from operating said latch bolt until said dead bolt is retracted.

16. A door lock according to claim 1 wherein said dead bolt includes a dead bolt mounting plate, said dead bolt mounting plate being provided with an arcuate compound dead bolt cam slot having a first portion which cooperates with said second lock means to deploy said dead bolt into its locking position and a second portion which prevents retraction of said dead bolt when said second locking means is in its third position.

* * * * *